United States Patent [19]

Brackmann et al.

[11] Patent Number: 4,557,278

[45] Date of Patent: Dec. 10, 1985

[54] TOBACCO LAMINA AND STEM PROCESSING

[75] Inventors: Warren A. Brackmann; Stanislav M. Snaidr, both of Mississauga, Canada

[73] Assignee: Rothmans of Pall Mall Canada Limited, Toronto, Canada

[21] Appl. No.: 469,098

[22] Filed: Feb. 23, 1983

[30] Foreign Application Priority Data

Mar. 2, 1982 [GB] United Kingdom ..... 8206084

[51] Int. Cl.[4] ..... A24B 3/08; A24B 3/18

[52] U.S. Cl. ..... 131/109.1; 131/108; 131/109.3

[58] Field of Search ..... 131/109 R, 109 B, 290, 131/109 AB, 31, 62, 79, 312, 306, 313, 364, 108

[56] References Cited

U.S. PATENT DOCUMENTS

| | | | |
|---|---|---|---|
| 255,494 | 3/1882 | Curtis et al. | 131/109 B |
| 4,074,722 | 2/1978 | Kohnhorst | 131/364 |
| 4,116,203 | 9/1978 | Wochnowski | 131/306 |
| 4,135,615 | 1/1979 | Brackmann et al. | 131/108 |
| 4,386,617 | 6/1983 | Brackmann et al. | 131/290 |

FOREIGN PATENT DOCUMENTS

| | | | |
|---|---|---|---|
| 699377 | 12/1964 | Canada | 131/410 |
| 341427 | 10/1921 | Fed. Rep. of Germany | 131/109 A |
| 1532085 | 5/1967 | Fed. Rep. of Germany | 131/109 R |
| 1895531 | 8/1970 | Fed. Rep. of Germany | 131/109 R |
| 2540411 | 3/1977 | Fed. Rep. of Germany | 131/109 R |

*Primary Examiner*—V. Millin
*Assistant Examiner*—Gregory Beaucage
*Attorney, Agent, or Firm*—Sim & McBurney

[57] ABSTRACT

Shredded tobacco lamina material and shredded stem material are mixed for use in cigarette making. A coarse intermixture of the materials first is formed and the mixture is metered and opened to form individual particles. The individual particles then are intermixed to form aggregates containing both lamina and stem material.

10 Claims, 1 Drawing Figure

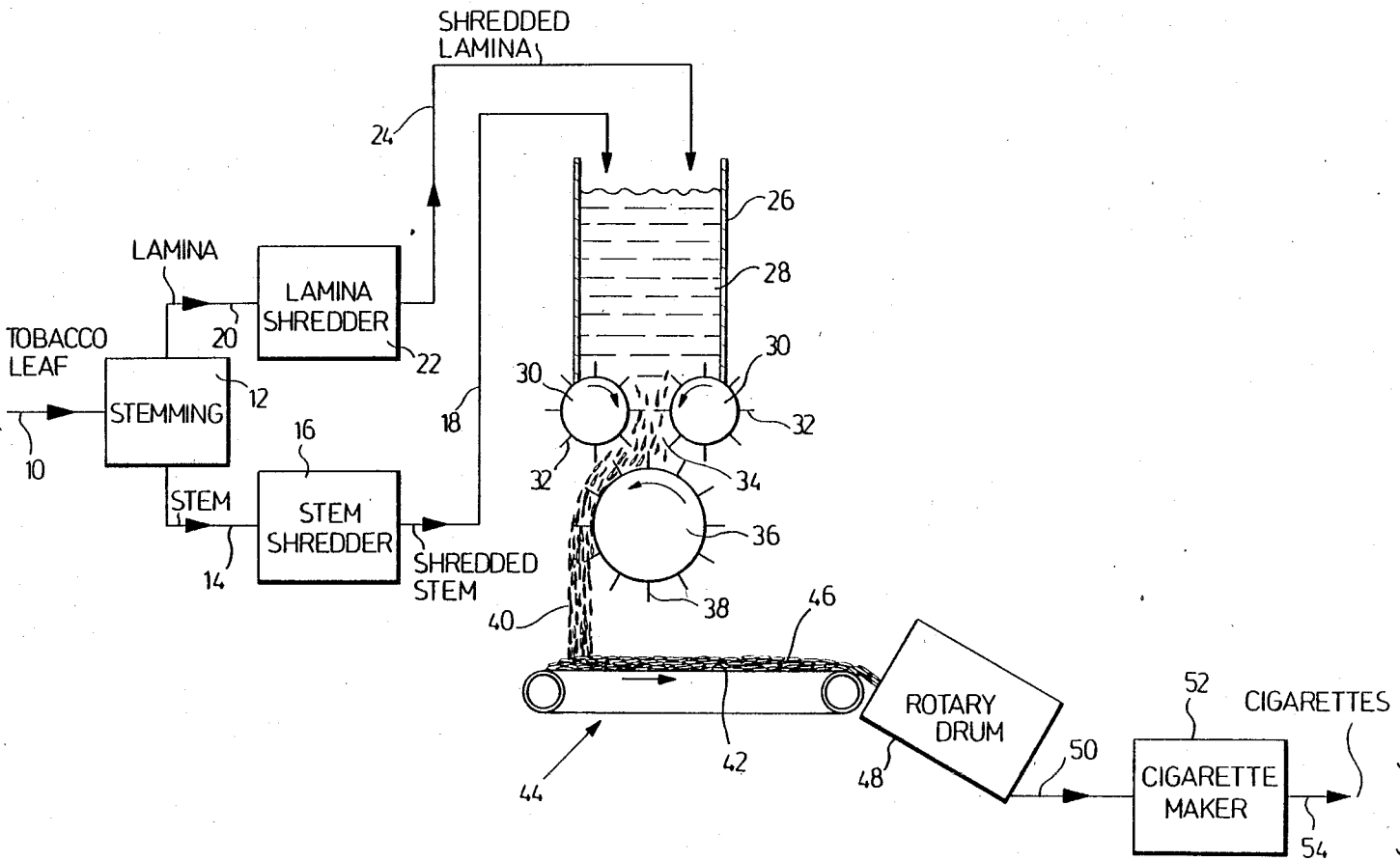
TOBACCO LEAF
10
STEMMING
12
LAMINA
20
STEM
14
LAMINA SHREDDER
22
STEM SHREDDER
16
SHREDDED LAMINA
24
18
SHREDDED STEM
26
28
30
32
34
36
38
40
42
44
46
ROTARY DRUM
48
50
CIGARETTE MAKER
52
CIGARETTES
54

TOBACCO LAMINA AND STEM PROCESSING

FIELD OF THE INVENTION

The present invention relates to the processing of tobacco lamina and stem to intermix the same for use in cigarette making.

BACKGROUND OF THE INVENTION

In the conventional processing of tobacco leaf to form tobacco suitable for the formation of cigarettes, the lamina portion of the leaf first is separated from the stem portion of the leaf by threshing, the lamina portion is cut or shredded to a size suitable for cigarette making, the stem portion usually is flattened and cut, and the resulting cut rolled stem (CRS) is mixed with the cut lamina shreds, or a blend of shreds, for example, by tumbling together in a rotating cylinder, to form the feed mix for the cigarette making machine. Although the cut rolled stem mixes well with the tobacco lamina shreds, the cut rolled stem tends also to separate readily from the tobacco shreds and hence tends not to remain uniformly mixed and distributed within the shreds, to the ultimate detriment of the quality of cigarette which is produced therefrom.

The applicants herein have developed a new procedure for the processing of stem material which involves the shredding of the stem between rotating ribbed plates. The latter procedure is the subject of U.S. Pat. No. 244,083 filed Mar. 16, 1981. (Now U.S. Pat. No. 4,386,617) in the names of Warren A. Brackmann et al and assigned to the assignee hereof, the disclosure of which is incorporated herein by reference. As set forth in this U.S. patent application, tobacco stem material first is thoroughly soaked in water to provide a moisture content of about 30 to about 60 wt %, the soaked stem material then is fiberized between counter-rotating ribbed discs spaced apart from 0.05 to 0.30 inches (1.25 to 7.5 mm), and then the fibrous shredded stem material is dried to a moisture content in the range of about 10 to about 16 wt %.

The product of the latter procedure is quite fibrous in character and has a similar physical appearance and has similar physical properties to the shredded lamina material. The reduced stem material is quite different in this respect from the cut rolled stem material which tends to be much more particulate in form.

Potentially, therefore, the shredded stem material is superior to cut rolled stem as a cigarette filler rod component. However, the fibrous shredded stem material resists ready mixing with the shredded lamina since both the shredded lamina and shredded stem material tend to form aggregations or clumps of particles.

The problem to which the present invention is directed is how to mix together effectively shredded stem material and shredded lamina material, so that the beneficial properties of the shredded stem material may be realized in cigarette making.

SUMMARY OF INVENTION

In accordance with the present invention, there is provided a method of mixing at least two fibrous tobacco products capable of forming aggregates, which comprises forming a coarse intermixture of the at least two fibrous tobacco products, opening the intermixture to form individual separate particles of the fibrous tobacco products, and mixing the individual separate particles to form aggregates containing the at least two fibrous tobacco products.

The present invention is applicable generally to the mixing of fibrous tobacco products which tend to form aggregates but will be described herein particularly with respect to the mixing of shredded lamina material and shredded fibrous stem material.

By opening the method flow of coarsely or grossly intermixed fibrous tobacco material to form individual separated fibrous tobacco particles, subsequent intermixing of the individual separated particles forms aggregates in which the two fibrous tobacco materials are present. In this way, shredded stem material becomes intimately associated with shredded lamina, and, once intermixed in this way, the shredded stem material resists separation from the shredded lamina, in contrast to CRS. Uniform mixing and distribution of shredded stem material within the lamina shreds is attained and this uniformity is retained in filler rod formation.

The present invention, therefore, enables shredded stem material to be effectively incorporated into a cigarette filler rod and thereby the beneficial properties of the shredded stem material may be realized in cigarrette making.

In accordance with a preferred embodiment of the present invention, shredded lamina material and shredded stem material are fed to a reservoir tube to be coarsely or grossly intermixed therein. The reservoir tube is open at the upper end to receive the lamina and stem material therein and is closed at the lower end by a tobacco metering device in the form of metering rollers. The metering rollers cooperate to meter the lamina and stem material from the reservoir tube at a desired flow rate. An opening device in the form of a further roller is provided to open the metered lamina and stem material to form individual separated particles of tobacco material.

The individual separated particles of lamina and stem are capable of blending and weaving with each other to form a tobacco filler rod suitable for cigarette rod formation, so that the shredded stem is integrally incorporated into the filler rod. To achieve this result in this preferred embodiment of the invention, the opened tobacco particles are collected on a horizontal conveying surface which conveys the particles to a rotary drum conveyor wherein the particles are tumbled as they are conveyed to form aggregate of particles containing both stem and lamina material. The rotary drum conveyor may take the form of a drier, so that the tobacco material particles are dried as they are tumbled and conveyed and form aggregates.

The procedure of the present invention, therefore, achieves incorporation of the shredded stem material into the filler rod and in a manner whereby separation of lamina and stem material is avoided.

This result contrasts markedly with the result which is obtained when cut rolled stem is utilized. Although more readily incorporated into the filler rod than shredded stem material, the cut rolled stem particles are incapable of integral incorporation into the filler rod, but rather tend to separate from the rod.

BRIEF DESCRIPTION OF DRAWING

The single FIGURE of the drawing is a schematic flow sheet of one embodiment of the invention.

DESCRIPTION OF PREFERRED EMBODIMENT

Referring to the drawing, leaf tobacco is fed by line 10 to a stemming operation 12 wherein lamina and steam material are separated by any convenient means. The resulting stem material is forwarded by line 14 to a stem shredder 16 to form shredded stem in line 18. The stem shredding operation is preferably that described in the aforementioned copending United States patent application, but any procedure which produces a shredded steam which is capable of forming aggregates and hence of being interwoven and forming aggregates with shredded lamina by the procedure of the invention, may be employed.

The stem-free lamina is passed from the stemming operation 12 by line 20 to a lamina shredder 22 wherein the lamina is processed to form tobacco shreds of dimensions suitable for feed to a cigarette making machine in line 24. The shredded stem in line 18 and the shredded lamina in line 24 are forwarded to a reservoir tube 26 to form a tobacco mass 28 of coarsely or grossly intermixed shredded lamina and shredded stem therein. A blend of shredded lamina material from different tobacco leaves may be used, if desired, to provide an end product of desired quality.

The shredded stem material fed by line 18 and the shredded lamina material 24 may have a moisture content which is approximately that desired for cigarette formation. Preferably, however, these fibrous tobacco materials have a higher moisture content, in the range of about 19 to about 35 wt %, since, at this moisture level, the tobacco material particles can be more readily opened without damaging them.

The relative proportions of shreded stem material fed by line 18 and shredded lamina material fed by line 24 depend on the proportions desired in the final blend for cigarette formation. Usually, the proportion of shredded stem material varies from about 2 to about 50 wt % of the fibrous tobacco material fed to the reservoir tube 26, with from about 98 to about 50 wt % being shredded lamina material.

Located at the lower end of the reservoir tube 26 in communication with the tobacco mass 28 are a pair of rotating rollers 30 which meter the desired amount of tobacco from the mass 28 at the desired flow rate. The rollers 30 are provided with a plurality of pins 32 which project radially outwardly from the surface. The radially-directed pins 32 are in substantial alignment with each other at the point of closest approach of the cylinders 30 and 32. This arrangement ensures control over the metering operation. As a result of the coarse intermixing of the shredded stem material and shredded lamina material in the tobacco material mass 28, the metered flow 34 contains a mixture of shredded stem material and shredded lamina material.

Arranged in the gap between the rollers 30 and hence in the path of movement of the metered flow 34 is an opening roller 36 which has radially-directed pins 38 extending from its surface and interdigitating with the pins 32 extending from the rollers 30. The opening roller 36 rotates at a speed sufficient to effect separation of the individual tobacco material particles in the metered flow 34 one from another to form a shower 40 of separated tobacco material particles.

One suitable structure of reservoir 26 and rollers 30 and 36 is described in U.S. Pat. No. 4,135,615, assigned to the assignee hereof.

The shower 40 of tobacco material particles is allowed to fall onto the upper surface 42 of moving horizontal conveyor 44 to form a stream 46 of tobacco material particles on the surface 42. The tobacco material particles in the stream 46 are in substantially separated condition, that is, they are not in the form of aggregates but rather in the form of individual particles. The tobacco material particles, however, are capable of forming aggregates under suitable mixing conditions.

The tobacco material stream 46 is fed by the conveyor 44 to an inclined rotary drum conveyor 48 wherein the tobacco material particles are conveyed from the higher end to the lower end and are also tumbled, as a result of rotation of the drum 48 about its axis. The tumbling action causes intermixing of the tobacco material particles and the formation of aggregates of those particles. Since the tobacco material fed to the rotary drum 48 includes both shredded stem and shredded lamina material, the aggregates which form include both fibrous materials in and interwoven form. The shredded stem material in this way becomes intermixed with shredded lamina material and the resulting product resists separation of the shredded stem material.

The tumbling and mixing operation effected in the rotary drum 48 may be combined with drying of the tobacco material in the drum 48. The drying may be effected in any convenient manner, such as by heating the drum 48 and/or by passing a heated gas therethrough. Such drying may be effected to provide the moisture content desired for cigarette making, usually about 10 to about 16 wt %, typicaly about 12 wt %. Drying usually is combined with mixing when the shredded stem material and shredded lamina material are fed to the reservoir 26 at the preferred moisture content of about 19 to about 35 wt %.

The formation of the tobacco material stream 44 and the use of a rotary drum conveyor 48 represents but one of several possible procedures for mixing the opened tobacco material particles to form aggregates of shredded tobacco stem material and shredded tobacco lamina material.

The intermixed tobacco material exiting the rotary drum conveyor 48 by line 50 is suitable for feed to a cigarette making machine 52 of any convenient construction for the formation of cigarettes 54 therefrom. The cigarettes 54 which result from cigarette formation have shredded stem material uniformly distributed therein in the proportion fed to the reservoir tube 26.

SUMMARY OF DISCLOSURE

In summary of this disclosure, the procedure of the present invention permits stem material separated from lamina in the stemming operation to be effectively and efficiently used in cigarette rod formation. Modifications are possible within the scope of this invention.

What we claim is:

1. A method of mixing shredded tobacco lamina material and shredded tobacco stem material, which comprises:

feeding shredded tobacco lamina material and shredded tobacco stem material from individual sources thereof simultaneously to a first mixing zone to form a coarse intermixture of said shredded tobacco materials, metering said coarse intermixture from said first mixing zone at a desired flow rate, mechanically opening said metered intermixture to form individual separated shredded tobacco particles, passing said separated shredded tobacco particles to a second mixing zone, and mixing said separated shredded tobacco particles in said second mixing zone to form aggregates of said shredded tobacco lamina material and said shredded tobacco stem material.

2. The method of claim 1 wherein said separated shredded tobacco particles form a shower of tobacco particles, said shower is collected in the form of a tobacco particles stream, and said stream is conveyed to said second mixing zone.

3. The method of claim 1 wherein said shredded tobacco lamina material and said shredded tobacco stem material are fed to said first mixing zone at a flow rate sufficient to provide about 2 to about 50 wt % of said shredded tobacco stem material and about 98 to 50 wt % of said shredded tobacco in said coarse intermixture.

4. The method of claim 3 wherein said shredded tobacco lamina material and said shredded tobacco stem material are fed to said first mixing zone at approximately the same moisture content in the range of about 19 to about 35 wt %.

5. The method of claim 4 wherein said separated shredded tobacco particles are dried in said second mixing zone simultaneously with said mixing therein to a moisture content of about 10 to about 16 wt %.

6. The method of claim 1 wherein said first mixing zone is constituted by an upright reservoir tube open at the upper end for receiving said shredded tobacco lamina material and said shredded stem material therein and communicating at the lower end with metering and opening means which effects said metering and opening steps.

7. The method of claim 6 wherein said second mixing zone is constituted by a rotary drum conveyor.

8. The method of claim 1 wherein said shredded tobacco stem material is formed by:

thoroughly soaking the tobacco stem material to a moisture content of about 30 to about 60 wt %, fiberizing the soaked stem material between counter-rotating fiberizing surfaces spaced apart from about 0.05 to about 0.30 inches, and drying the resulting shredded stem material to a moisture content to about 10 to about 16 wt %.

9. Apparatus for mixing shredded tobacco lamina material and shredded tobacco stem material, which comprises:

upright reservoir tube means open at the upper and lower ends thereof, feed means for feeding shredded tobacco lamina material to said reservoir tube means, feed means for feeding shredded tobacco stem material to said reservoir tube means, metering means communicating with the lower end of said reservoir tube means to meter coarsely intermixed shredded tobacco material from said reservoir tube means, said metering means comprising a pair of counter-rotating rollers having radial projections which are in substantial alignment at the point of closest approach of the rollers to each other, opening means located adjacent said metering means for opening the stream metered by said metering means to form individual separated shredded tobacco particles in the form of a falling shower, said opening means comprising a roller located below said rollers of said metering means and equidistant therefrom, said opening means rollers having radial projections which interdigitate with the radial projections of said metering means rollers, horizontally-extending conveyor means located below said opening means and in the intended path of said falling shower to collect the shredded tobacco particles of the shower to form a stream of tobacco particles on said conveyor means, and rotary drum means located at the downstream end of said conveyor means for receiving said stream of tobacco particles from said conveyor means for tumbling and mixing the same in said drum means while said particles are conveyed therethrough.

10. The apparatus of claim 9 wherein said rotary drum means is rotary drier drum means for drying said tobacco particles therein.

* * * * *